US005087171A

United States Patent [19]

Dosch et al.

[11] Patent Number: 5,087,171

[45] Date of Patent: * Feb. 11, 1992

[54] PAPER PULP CENTRIFUGAL PUMP WITH GAS SEPARATION

[75] Inventors: Joseph B. Dosch, Auburn; Charles A. Cappellino, Seneca Falls; George Wilson, Skaneateles; James C. Osborne, Seneca Falls, all of N.Y.

[73] Assignee: Goulds Pumps, Incorporated, Seneca Falls, N.Y.

[ * ] Notice: The portion of the term of this patent subsequent to Jun. 26, 2007 has been disclaimed.

[21] Appl. No.: 538,849

[22] Filed: Jun. 15, 1990

Related U.S. Application Data

[63] Continuation-in-part of Ser. No. 384,787, Jul. 25, 1989, Pat. No. 4,936,744.

[51] Int. Cl.[5] ..... F03B 11/04; F04D 1/10

[52] U.S. Cl. ..... 415/169.1; 415/24; 162/380; 162/275

[58] Field of Search ..... 162/380, 275; 415/169.1, 24

[56] References Cited

U.S. PATENT DOCUMENTS 4,770,604 9/1988 Luthi et al. ..... 415/169.1

4,936,744 6/1990 Dosch et al. ..... 415/169.1

*Primary Examiner*—Edward K. Look

*Assistant Examiner*—Michael S. Lee

*Attorney, Agent, or Firm*—Bean, Kauffman & Spencer

[57] ABSTRACT

The invention relates to a centrifugal pump particularly adapted for pumping fibrous suspensions from within a reservoir, wherein the pump includes a rotor arranged wholly within the reservoir for cooperation with the bottom wall thereof to effect fluidization of suspension and discharge of the fluidized suspension from the reservoir for passage through the pump, wherein an entrained gas, such as air, is withdrawn from the pump by means of a unique pump-out mechanism disposed rearwardly of a shroud of an impeller of the pump and including pump-out vanes and a repeller shroud cooperating with the impeller shroud and pump-out vanes to define radially opening flow paths, wherein flow openings extend across the impeller shroud for flow communication with the radially opening flow paths. The mechanism may also include repeller vanes carried by the repeller shroud to extend rearwardly of pump-out vanes.

16 Claims, 3 Drawing Sheets

PAPER PULP CENTRIFUGAL PUMP WITH GAS SEPARATION

REFERENCE TO RELATED APPLICATION

This application is a Continuation-in-Part of U.S. patent application Ser. No. 07/384,787 now U.S. Pat. No. 4,936,744, filed July 25, 1989.

BACKGROUND OF THE INVENTION

The invention relates to centrifugal pumps adapted for use in pumping liquids having a gas content, and more particularly to centrifugal pumps adapted to effect removal of gas from a pumped liquid in order to improve pump performance or processing of the pumped liquid.

It is well known that the presence of a gas, such as air, in a pumped liquid may tend to decrease the hydraulic efficiency of a centrifugal pump, and that gas separated from the pumped liquid may collect in sufficient quantity adjacent the front of the hub or eye of the pump's impeller, as to cause the output of the pump to cease. Separation of gas from the pumped liquid may be due to centrifugal action imparted to the liquid by the pumping vanes of an impeller of the pump or at a point upstream of the impeller adjacent the suction inlet of the pump, such as for instance where it is necessary to employ a separate fluidizer or centrifuge to fluidize or render free flowing a high consistency fibrous suspension, such as paper pulp, for pumping purposes.

It is also known that gas tending to collect in proximity to the hub of the impeller of a centrifugal pump may be removed by providing a flow path defined by flow openings arranged to extend through a shroud or hub of the impeller for purposes of placing front and rear surfaces of the impeller in flow communication; a vent chamber opening through a rear wall of a pumping chamber of the pump adjacent an impeller drive shaft for receiving gas passing through the flow openings and a vent conduit for placing the vent chamber in flow communication with a gas receiving or collecting reservoir, such as the atmosphere, either directly or via an auxiliary vacuum pump, depending on the difference between the suction head, i.e. the pressure existing at the suction inlet of the pump, and the pressure of the gas receiving reservoir. In that there is rarely complete separation of ga from liquid at that point adjacent the front of the impeller with which the flow openings communicate, there is a tendency for a quantity of liquid to escape with the gas through the flow openings, and for this reason it is common practice to provide pump-out vanes on the rear surface of the impeller shroud, which are intended to preferentially act on the liquid component of the gas-liquid mixture passing through the flow openings for purposes of pumping same to the discharge of the pump and thus prevent passage of liquid from the pumping chamber into the vent conduit. Prior pumps of this general type are disclosed for example in U.S. Pat. Nos. 1,101,493; 3,944,406; 4,410,337 and 4,435,193, and Canadian Patent No. 1,158,570.

It has also been proposed, as in U.S. Pat. No. 3,230,890, to provide an auxiliary pump or centrifugal separator for separating gas from liquid escaping from the pumping chamber of a centrifugal pump.

Under certain steady state conditions, a centrifugal pump fitted with properly sized pump-out vanes may be operated to effect removal of gas in quantities sufficient to permit the pump to operate at an efficiency level corresponding to that characteristic of pump operation with liquid having essentially no gas content without loss of liquid through the vent conduit.

In actual practice, steady state pump inlet conditions are rarely encountered and slight changes in the pressure differential existing across the pump from some predetermined value will either adversely affect the efficiency of a centrifugal pump or allow for loss of liquid through the vent conduit. For example, if the pressure differential across the pump should decrease, due to either a decrease of the suction head and/or an increase in pressure in the gas receiving reservoir, there would be a reduction in the amount of gas removed from the pumped liquid and this would result in a reduction in pump efficiency. There would, however, be no loss of liquid through the vent conduit. Conversely, if the pressure differential across the pump should increase, due either to an increase in suction head or a reduction in pressure in the gas receiving reservoir, pump efficiency would remain essentially the same, but liquid would escape through the vent conduit.

In that in practice it is difficult or impossible to provide a constant suction head and ensure that liquid to be pumped has a uniform gas content, it has been proposed for instance in U.S. Pat. Nos. 3,944,406; 4,410,337 and 4,435,193 and Canadian Patent No. 1,158,570 to arrange a gas flow control valve in the vent conduit leading to a constant speed vacuum pump and to continuously adjust the valve in a manner determined by sensed changes in various pump operating parameters in an attempt to vary the pressure drop across the pump as required to maximize pump efficiency, while avoiding loss of pumped liquid through the vent conduit.

It has also been proposed for example in U.S. Pat. No. 4,780,053 to fit the pump shaft of a centrifugal pump with a rotor arranged to cooperate with vanes or ribs carried by the walls of an outlet opening of a suspension reservoir and the inlet opening of the pump to fluidize suspension passing therethrough.

SUMMARY OF THE INVENTION

The present invention is directed towards an improvement in the centrifugal pump construction disclosed in copending U.S. patent application Ser. No. 07/384,787 now U.S. Pat. No. 4,936,744, filed July 25, 1989, and more particularly to a pump construction adapted for use in pumping fibrous suspensions from a reservoir of varying heights without requiring precise control of the pressure drop across the pump and at relatively low pump rotational speeds without resorting to providing suspension flow impeding fluidizing vanes or ribs lining the suspension flow path extending from the reservoir to the interior of the pump.

A pump formed in accordance with the present invention is of conventional construction from the standpoint that it includes a housing defining a pumping chamber having an axially opening suction inlet communicating with a discharge opening defined by discharge means of a reservoir for fibrous suspension and a radially opening discharge outlet; an impeller mounting for rotation within the pumping chamber by a drive shaft, which is aligned with the suction inlet and arranged to extend rearwardly of the impeller through an opening formed in a rear wall of the pumping chamber; and a gas removal system for removing gas tending to collect within the pumping chamber rearwardly of the impeller. More specifically, the impeller includes a shroud extending radially of the drive shaft and having flow openings extending between front and rear surfaces thereof; pumping vanes carried by the front surface of the shroud for pumping liquid between the suction inlet and discharge outlet; and pump-out vanes carried by the rear surface of the shroud for pumping liquid passing rearwardly of the impeller through the flow openings for discharge through the discharge outlet. The gas removal system includes a vent recess opening through the rear wall of the pumping chamber annularly of the drive shaft, a vacuum pump, a gas vent conduit connecting the vent recess to the vacuum pump, and a gas flow control valve arranged in the gas discharge conduit for varying the pressure within the vent chamber. A rotor is fitted on the drive shaft forwardly of the impeller to effect fluidization of fibrous suspension to be pumped and aid in separation of gas from the suspension under centrifugal action, such that gas is permitted to collect in a core or "gas bubble" forwardly of the eye of the impeller and concentrically of the drive shaft.

The pump of the present invention is like that disclosed in our above referenced pending application in that its impeller is fitted with a repeller shroud, which is mounted to extend radially from the hub of the impeller and cooperate with the impeller shroud and pump-out vanes to define radially extending flow paths communicating with flow openings extending through the impeller shroud for purposes of imparting a well defined radial flow component to gas and liquid passing rearwardly of the impeller through the flow openings. The repeller shroud may be fitted with rearwardly extending repeller vanes adapted to project into an annular recess formed in a rear wall of a pumping chamber of the pump concentrically outwardly of its vent recess. The utilization of an impeller of this construction allows an otherwise conventional centrifugal pump to be employed for example in a typical pulp mill installation for pumping a high consistency fibrous suspension from a reservoir subject to variation in suspension level at maximum pump efficiency and with no loss of suspension through the vent conduit of the pump without requiring continuous adjustments of the pressure differential across the pump.

In accordance with the present invention, the rotor employed to effect fluidization of suspension is positioned wholly within the confines of a reservoir and arranged to cooperate with the bottom wall of the reservoir for this purpose. This arrangement permits fluidization to occur at relatively low pump shaft rotational speeds without requiring the inclusion in the discharge opening of the reservoir and inlet opening of the pump of suspension flow inhibiting shear ribs or the like.

BRIEF DESCRIPTION OF THE DRAWINGS

The nature and mode of operation of the present invention will now be more fully described in the following detailed description taken with the accompanying drawing wherein.

DETAILED DESCRIPTION

Figure 1:
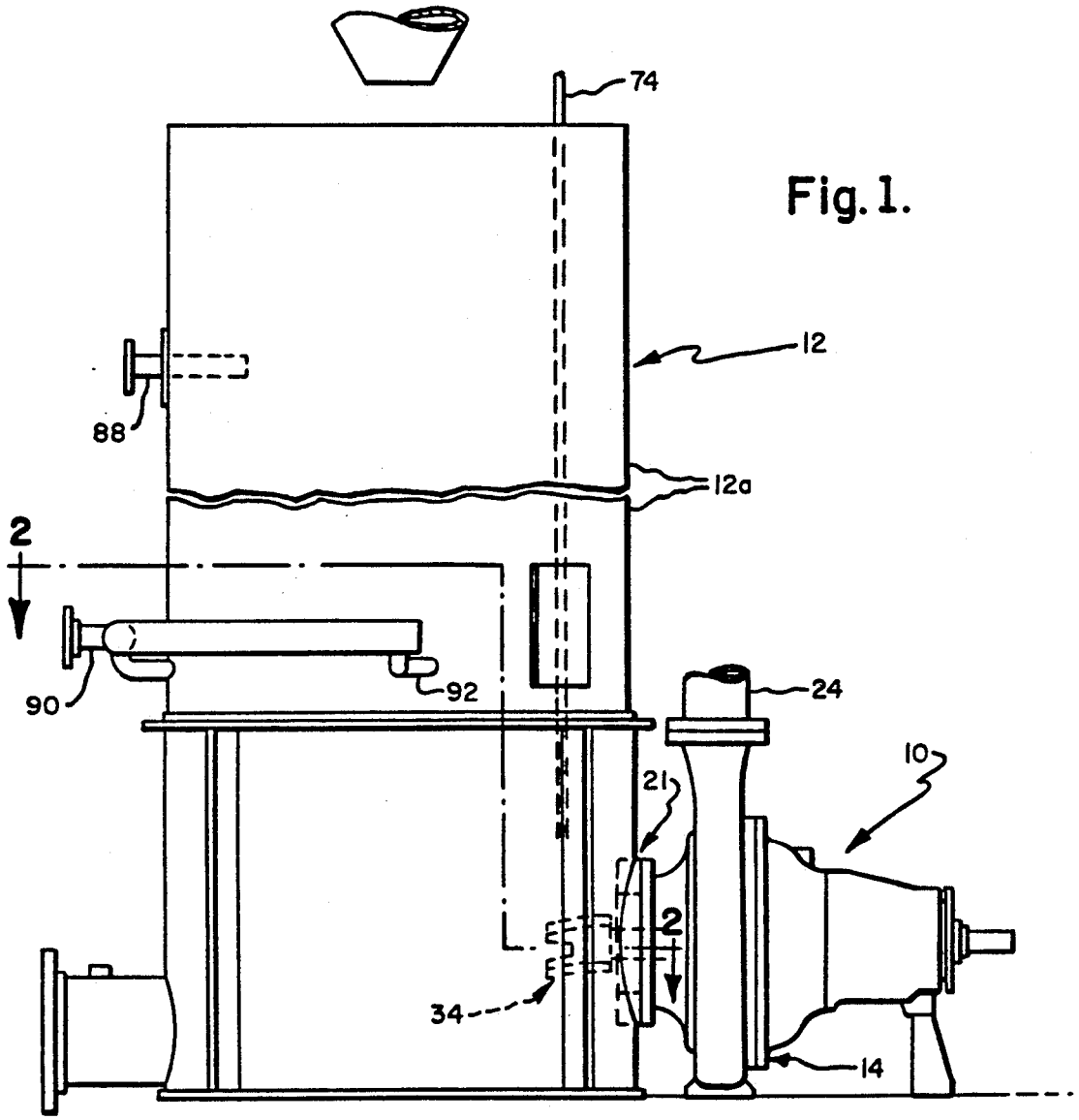
FIG. 1 is a fragmentary, elevational view of a pump of the present invention shown in association with a reservoir in the form of a standpipe.
Figure 2:
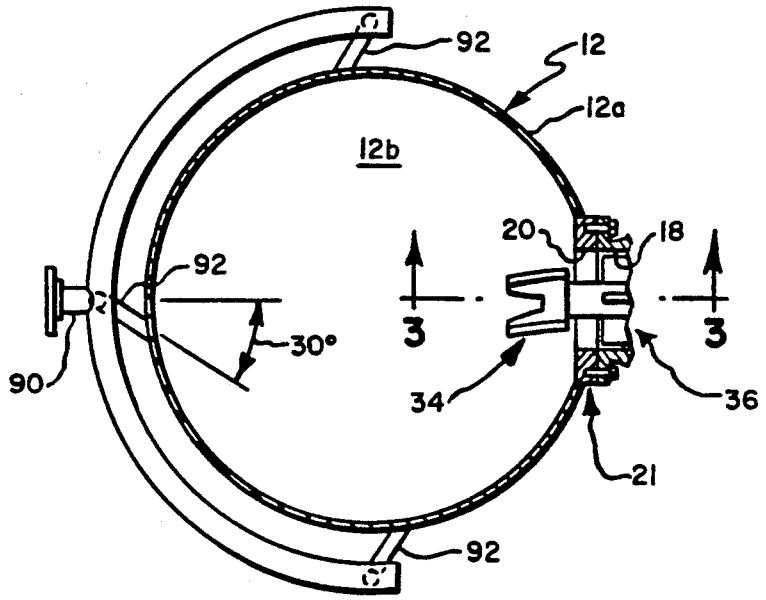
FIG. 2 is a sectional view taken generally along the line 2—2 in FIG. 1.

Reference is first made to FIG. 1, wherein a pump formed in accordance with the present invention is generally designated as 10 and shown in association with a reservoir, such as a standpipe 12, from which a fibrous suspension is to be pumped.

Figure 3:
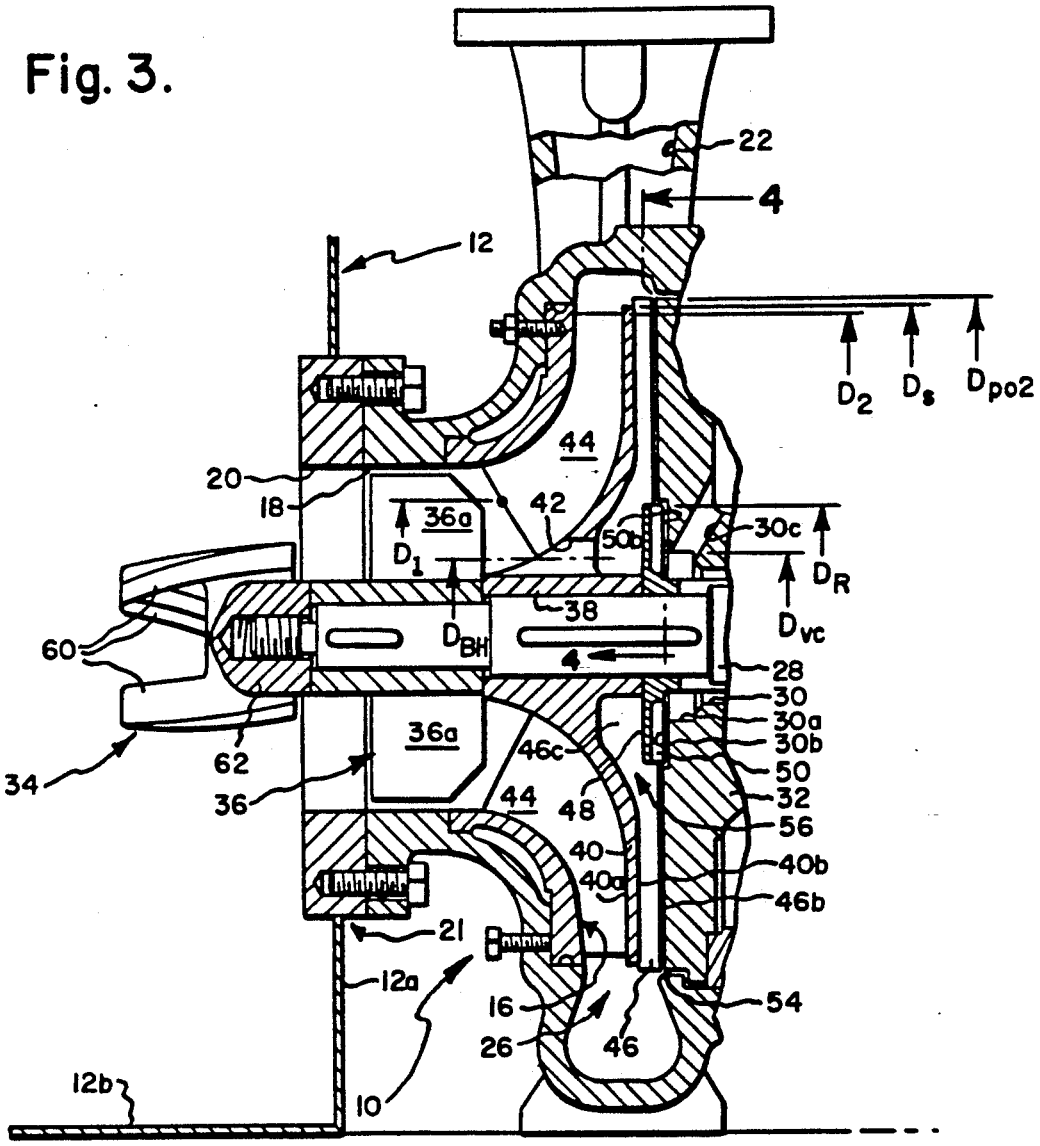
FIG. 3 is an enlarged sectional view taken generally along the line 3—3 in FIG. 2.

Pump 10 is shown in FIG. 3 as including a housing 14 defining a pumping chamber 16 having an axially opening suction inlet 18 communicating with the interior of standpipe 12 via a discharge or outlet opening 20 defined by discharge means 21 and a radially opening discharge outlet 22 connected to a discharge conduit 24; an impeller 26 mounted for rotation within the pumping chamber by a drive shaft 28, which is axially aligned with the suction inlet opening and extends rearwardly of the impeller through an opening 30 in a rear wall 32 of the pumping chamber for connection with a suitable motor, not shown; a first rotor 34 carried adjacent a free end of the drive shaft and arranged wholly within the confines of the standpipe; and a second rotor 36 carried by the drive shaft and arranged within the suction inlet. Rear wall 32 is also provided with inner and outer vent recesses 30*a* and 30*b* disposed essentially concentrically of drive shaft opening 30, and a vent passage 30*c* connected into recess 30*a* or into both recess 30*a* and the radially inner portion of recess 30*b*, as shown in FIG. 3.

Impeller 26 is shown in FIG. 3 as including a central hub 38 mounting a radially extending impeller shroud 40 having front surface 40*a* and a rear surface 40*b* arranged to face towards suction inlet 18 and pumping chamber rear wall 32, respectively; at least one and preferably a plurality of flow openings 42 extending between the front and rear surfaces of the shroud; a plurality of pumping vanes 44 carried by the front surface of the shroud for pumping liquid from suction inlet 18 to discharge outlet 22; a plurality of pump-out vanes 46 extending radially from the impeller hub for pumping liquid passing rearwardly of the impeller through the flow openings radially towards the discharge outlet; a repeller shroud 48 arranged to extend radially from the hub rearwardly of impeller shroud 40 and a plurality of repeller vanes 50 arranged rearwardly of the repeller shroud and to project rearwardly beyond rear edges 46*b* of the pump-out vanes for receipt within annular recess 30*b*. The diameters $D_{PO2}$, $D_S$ and $D_2$ of pump-out vanes 46, shroud 40 and pumping vanes 44, respectively, are shown as having the relationship of $D_{PO2} \geqq D_S \geqq D_2$. Diameters $D_{PO2}$ and $D_S$ are preferably greater than $D_2$, but pump-out vanes 46 may otherwise be of a number, axial dimension, shape and arrangement to ensure that the head generated by the pump-out vanes will equal and preferably exceed the head generated by the pumping vanes in order to prevent flow of pumped liquid towards the rear of impeller 26 about the periphery of shroud 40. In that for the illustrated construction, the head generated by pump-out vanes 46 decreases, as the axial gap or spacing 54 between the radial surface 32*a* defined by rear wall 32 and the rear edges 46*b* of pump-out vanes 46 increases, as for instance would be the case when the impeller is moved forwardly within the pumping chamber to accommodate for wear, it is desirable to initially maintain the gap as small as possible, such as for example on the order of between 0.015 and 0.050 inch.

Repeller shroud 48 is required to be sized and arranged, such that it cooperates with impeller shroud rear surface 40*b* and the inner ends 46*c* of pump-out vanes 46 to provide a plurality of well defined radial flow paths 56, which receive gas and liquid passing through the rear ends of flow openings 42 and then serve to propel same radially outwardly of the flow openings towards discharge outlet 22. Thus, the diameter $D_R$ of repeller shroud 48 is required to be no less than $D_{BH}$ and preferably to exceed the latter sufficiently to ensure that all materials passing through flow openings 42 are caused to experience radial acceleration prior to reaching the outer rim 48*a* of the repeller shroud. Diameter $D_R$ is also required to equal and preferably exceed the diameter $D_{VC}$ of inner recess 30*a*, and for the construction shown in FIG. 3 would preferably correspond essentially to the diameter o outer recess 30*b*. In any event, repeller shroud 48 must extend radially outwardly of the inlet end of vent passage 30*c*. Where pump-out vane rear edges 46*b* are required to cooperate with rear surface 32*a* for head generation purposes, $D_R$ should not exceed a value required to properly define flow paths 56, since otherwise the presence of repeller shroud 48 would diminish the head producing capability by pump-out vanes 46. The axial spacing between repeller shroud 48 and rear edges 46*b* of pump-out vanes 46, and thus rear surface 32*a*, does not appear to be critical, so long as it is sufficient to permit free passage of gas over rim 48*a* and then radially inwardly towards recess 30*a*.

Figure 4:
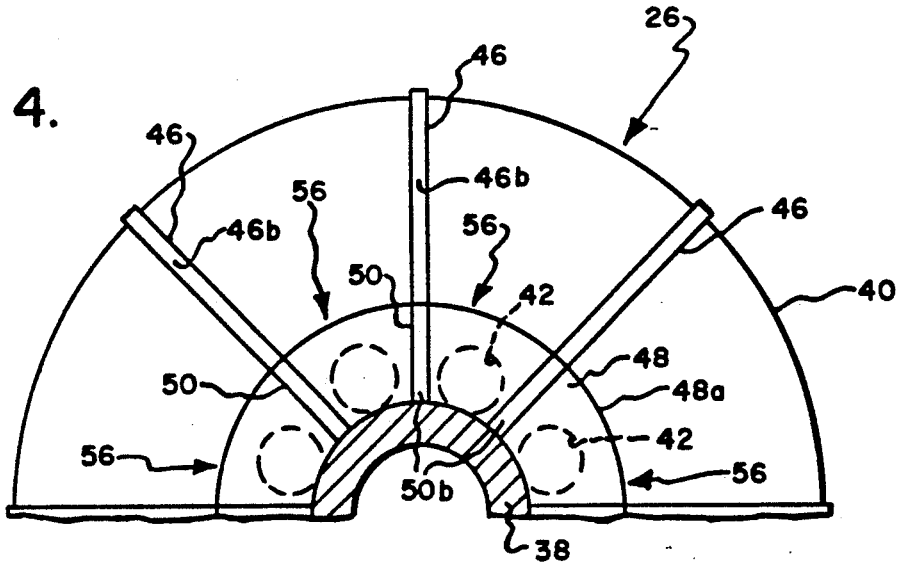
FIG. 4 is a sectional view taken generally along the line 4—4 in FIG. 3.

Repeller vanes 50 are shown in FIGS. 3 and 4 as having rear edges 50*b* spaced from the rear wall of recess 30*b* by an amount corresponding essentially to gap 54, and as being arranged to extend radially of hub 34 in alignment one with each of pump-out vanes 46.

Flow openings 42 must be spaced radially of the axis of rotation of impeller 26 such that they are located at a diameter $D_{BH}$, which does not exceed the value of $D_1+D_2,/2$ wherein $D_1$ and $D_2$ are the mean inlet and outlet diameters of pumping vanes 44. The shape, size, number and placement of flow openings 42 appear to be matters of choice depending on impeller design and pump requirements. However, flow openings 42 must be of sufficient overall area to allow for withdrawal of gas tending to collect forwardly of impeller 26 and individually be of sufficient size to minimize the likelihood of blockage by solids. Moreover, flow openings 42 would desirably be placed as close as possible to the rotational axis of impeller 26 and may pass through hub 38, and thus across impeller shroud 40, if allowed by the design and size of the impeller. In FIG. 4, flow openings 42 are shown as being placed in alignment on with each of flow paths 56. Alternatively, flow openings 42 may be arranged in alignment with alternate flow paths 56 when such flow paths are arranged in communication adjacent hub 38 by spacing the inner ends of all or alternative ones of pump-out vanes 46 from the hub.

First rotor 34 is shown in FIG. 3 as consisting of a plurality of radially extending and axially elongated blades 60 interconnected at their rear ends by a hub 62 fixed for rotation with the free end of drive shaft 28. Blades 60 may be straight, but are preferably curved in a direction extending axially of shaft 28 for purposes of imparting both radially directed and axially directed forces to the suspension to be pumped. It is critical to the practice of the invention that suspension discharge means 21 be arranged to extend through a vertically disposed side wall 12*a* of standpipe 12 relatively adjacent a bottom wall 12*b* thereof in order to arrange rotor 34 sufficiently close to such bottom wall as will permit cooperation therebetween to create sufficient turbulence in the suspension as required to effect fluidization thereof within the standpipe and permit resultant flow thereof as a liquid outwardly of the standpipe through discharge opening 20. More specifically, fluidization is achieved by shear forces introduced into the suspension as a result of the turbulence producing interference by bottom wall 12*b* with the generally cylindrical or annular flow pattern otherwise introduced into the suspension by rotation of first rotor 34. As by way of example, fluidization of suspension having an 8% fiber content may be achieved by providing first rotor 34 with three axially curved blades 60, which have axial lengths of about 6 inches and are arranged to provide an overall first rotor diameter of about 6 inches, wherein the axis of rotation is spaced about 12.5 inches from bottom wall 12*b* and a rotational speed equal to or greater than about 1750 rpm is imparted to the first rotor. This arrangement avoids the requirement of the prior art that turbulence inducing "shear" ribs be affixed to project radially inwardly of suction inlet 18 and discharge opening 20 for cooperation with a rotor extending co-axially therewithin, and has the advantage that flow of suspension is not impeded by the presence of such ribs.

As an incident to fluidization of suspension within standpipe 12, air tends to be separated therefrom and collect or concentrate in an annular core area immediately adjacent pump shaft 28. Gas or liquid rich in gas is allowed to pass axially of pump shaft 28 and then through flow openings 42, whereupon it is subjected to centrifugal action imparted by pump-out vanes 46 to allow gas to tend to collect adjacent the drive shaft and any liquid passing through the flow openings to be forced outwardly towards pump discharge outlet 22. For those installations where operation of rotor 34 is found to effect sufficient separation of air from the fluidized suspension to be pumped, second rotor 36 may be dispensed with. However, when it is found necessary to employ second rotor 36 for air separation purposes, such rotor would be mounted immediately adjacent impeller 26 concentrically within suction inlet 18 and preferably consist of a plurality of essentially flat, radially extending blades 36*a* intended to impart centrifugal force to the fluidized suspension flowing towards the impeller.

The operation of impeller 26 is essentially similar to a like sized/shaped standard impeller fitted with flow openings 42 and pump-out vanes 46, except that repeller shroud 48 blocks direct axial flow communication between the flow openings and vent recesses 30*a* and 30*b*, and thus the inlet end of vent passage 30*c*, and causes initial flow of all material passing through the flow openings to be directed radially outwardly along flow paths 56. By the time the flow of materials reaches rim 48*a*, it is sufficiently well defined to ensure that its heavy constituents, i.e. liquid and solids, will tend to continue to move radially outwardly under the continuing influence of pump-out vanes 46 even though exposed to a reduced pressure condition present in vent passage 30*c*. However, a reduced pressure condition present in vent passage 30*c* is sufficient to deflect the relatively lightweight gas constituent of the flow and cause same to pass around rim 48*a* for flow radially inwardly towards the inlet end of the vent passage. Repeller vanes 50 function as a secondary centrifugal separator normally serving to radially expel droplets of liquid, which might be entrained in the separated gas, and when required serving to generate a head opposing inward flow of liquid towards the vent recess 30*a*.

Figure 5:
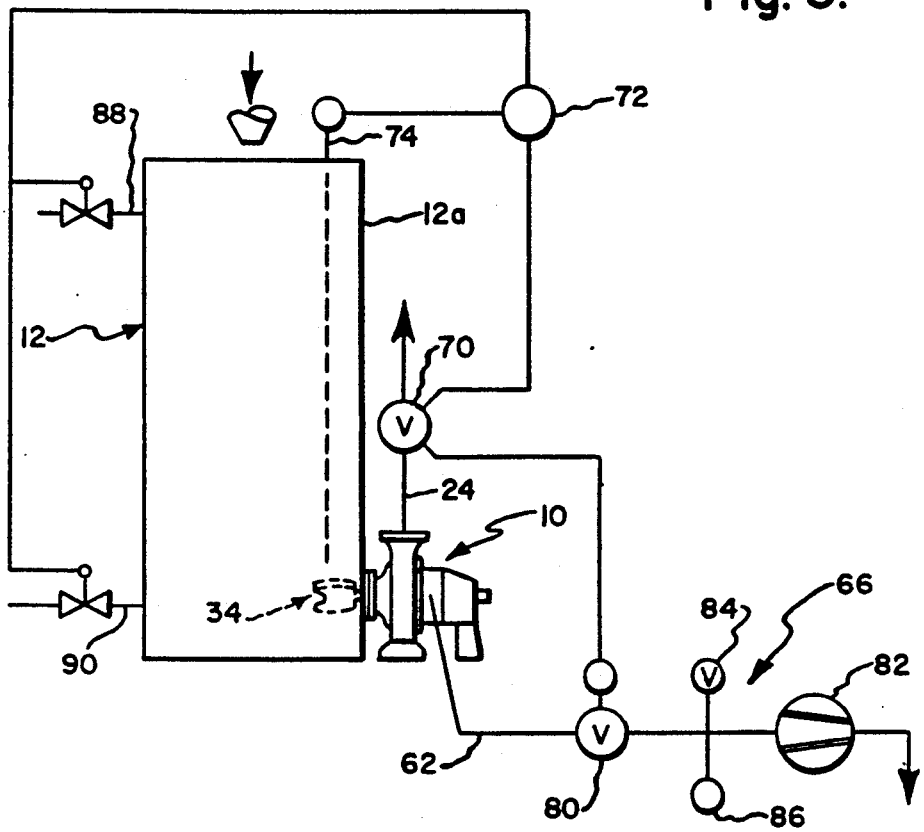
FIG. 5 is a diagrammatic view of a control system adapted for use with the present pump.

Gas tending to collect within recesses 30*a* and 30*b* may be withdrawn by placing vent passage 30*c* in flow communication with a vent conduit 62 for delivery to a suitable gas collection reservoir, either directly or indirectly, via a gas removal system of the general type designated as 66 in FIG. 5.

It is desirable to prevent pump 10 from running dry, and accordingly for installations subject to substantial, periodic changes in suction head, e.g. the height of suspension in standpipe 12 above suction inlet 18, discharge conduit 24 would be provided with a liquid flow control valve 70 operated by a signal(s) from a programmable controller 72 in response to the level of liquid within the standpipe, as may be sensed by a conventional cable type level measuring or sensing device 74. Under normal operating conditions, flow control valve 70 would be adjusted in a manner tending to maintain the height of liquid within standpipe 12 at some predetermined value.

In the gas removal system 66 shown in FIG. 5, gas vent conduit 62 communicates with a suitable gas collection reservoir, not shown, such as the atmosphere for the case where the gas to be removed is air, and a gas flow control valve 80 and a motor powered vacuum pump 82 are connected thereinto. Where the withdrawn gas is air, a vacuum regulator, such as may be defined by a manually adjustable atmosphere air bleed valve 84, may be connected into conduit 62 immediately upstream of vacuum pump 82 to permit the vacuum pump to be run continuously when gas control valve 80 is closed. A pressure sensing device 86 may be provided to facilitate adjustment of valve 84. The construction and mode of operation of gas removal system 66, as thus far described, is conventional.

Laboratory tests have been conducted using a standard 4×8-14 centrifugal pump manufactured by Goulds Pumps, Incorporated of Seneca Falls, N.Y. to pump water having 15% air content. The standard pump employed a semi-open impeller fitted with pump-out vanes and its vent passage was exhausted directly to the atmosphere. It was determined that the pump was capable of generating a discharge head and flow rate comparable to that obtainable when pumping pure water and without loss of water through its vent passage for a steady state condition where the pressure differential across the pump, i.e. the difference between the suction head or pressure existing at its suction inlet and the vent pressure existing in its vent passage, was maintained equal to a reference value of about fifteen feet of water. It was observed that, when the pressure differential was decreased below the reference value, which may occur either as a result of a reduction in suction head or the introduction of a positive pressure in the vent passage, a reduced quantity of air was vented from the pump, thereby causing the efficiency of the pump to fall below that obtainable when pumping pure water. On the other hand, when the pressure differential was increased about the reference value, which may occur either as a result of an increase in suction head or the introduction of a negative pressure in the vent passage, the efficiency of the pump was comparable with that obtainable when pumping pure water, but a loss of water through its vent passage was observed.

Tests were also conducted using a 4×8-14 pump fitted with an impeller modified in the manner depicted in FIGS. 3 and 4 to pump water having a 15% air content connected into a supply providing a suction head of about fifteen feet. The vent passage was connected to a vacuum pump and tests conducted to determine the effect of different pressure differentials across the pump. It was observed that the performance of the thus modified pump corresponded essentially to that of the standard pump for pressure differential conditions equal to and below the reference value of the standard pump. However, it was determined that the modified pump was capable of performing at an efficiency comparable to that obtainable when pumping pure water and without loss of water through its vent passage for pressure differentials in a range exceeding the reference value by upwards of fifteen feet of water.

Standard centrifugal pumps may be readily adapted for use in pumping any given liquid, including fluidized fibrous suspensions, having entrained gas under steady state conditions of suction head and gas content by simply ensuring that the pressure existing in its vent passage is maintained at a constant value, which is correlated with a constant value of the suction head to maintain a pressure differential across the pump equal to some predetermined reference value at which the pump operates at maximum possible efficiency without loss of liquid through its vent passage. The predetermined reference value would be expected to vary depending upon the type of liquid being pumped and the size and operating characteristics of the pump itself. However, for pump installations not enjoying steady state conditions, such as those encountered in pulp mills in connection with the pumping of high consistency fiber stock suspensions, it is necessary to provide a control for continuously varying the pressure existing in the vent passage of a standard pump in an effort to maintain the pressure conditions across the pump at its predetermined reference value, as the available suction head raises and falls relative to some average design value.

As by way of illustration, in a typical pulp mill installation generally depicted in FIG. 5, suspension is fed at a variable rate to a suitable reservoir, such as standpipe 12 having a height for example on the order of about ten feet, as measured about the suction inlet of the pump; the discharge flow rate of the pump is controlled, as by adjustments of flow control valve 70, with a view towards maintaining the height of the suspension at some design value; and ga flow control valve 80 is adjusted as required to vary the pressure differential across the pump, in order to accommodate for increases and decreases of the height of the suspension relative to the design value. It has been observed that for the case where a standard pump is employed to pump high consistency fibrous suspensions of on the order of about 12%, vacuum pump 84 should be operated to provide a negative pressure in vent conduit 62 of about five feet of water for a design value or suspension height of five feet in order to provide a pressure differential across the pump, which appears to maximize pump efficiency without creating a loss of suspension through the vent passage. While diverse types of controllers 72 are presently in use, a typical controller would be of the programmable variation, wherein the setting of liquid flow control valve 70 is determined by the height of suspension, as measured by sensor 74, as a function of time.

For example, a set point, such as a suspension height of five feet, is established and when upon initially filling of standpipe 12 the suspension reaches five feet, valve 70 would start to open and thereafter might settle for movement within a range of 30% to 35% open condition as the suspension height varies between four and a half feet and five and a half feet. Valve 70 would typically open 100%, if the suspension height was to approach eight feet, and might become fully open at lesser suspension height under certain conditions. Valve 70 would be fully closed when the level of the suspension dropped to an undesired level, during an intended period of pump operation, or when the pump was shut down upon completion of an intended draining of the reservoir.

It is proposed to employ a pump modified in accordance with the present invention in a pulp mill installation of the type described and to modify operating conditions by reducing the negative pressure provided by vacuum pump 82 from five feet of water given in the above example to an arbitrary selected low value, such as ten feet of water, to allow pump operation throughout essentially the whole of possible variations of height of suspension within standpipe 12 without adjustments of gas control valve 80 other than alternatively placing same in fully open or fully closed condition incident to an arbitrarily selected setting of liquid control valve 70. Specifically, it is proposed to operate vacuum pump 84 at a negative pressure sufficient to create a pressure differential across the pump when the height of the suspension is at its design value, which exceeds the pressure differential required by the modified pump to maximize withdrawal of as therefrom, whereby to permit the pump to operate at maximum efficiency throughout the range of obtainable suspension levels within standpipe 12 without loss of suspension through vent conduit 62.

To carry operation of the modified pump into effect, a relatively low liquid control valve setting, such as 20% open, may be selected on the basis that such setting would normally be encountered only during initial filling of standpipe 12 and subsequent emptying of such standpipe, as an incident to shutdown of operation, such as for maintenance purposes. Thus, it is contemplated that gas control valve 80 be fully closed at the start-up of pump operation and become fully open when liquid control valve 70 initially is opened to a setting of 20%, whereafter the gas control valve would remain fully open until the liquid control valve returned to a setting of 20% normally again encountered at the time of shutdown. Preferably, the setting of gas control valve 80 would be directly responsive to the setting of liquid control valve 70, as indicated in FIG. 5, but may if desired be controlled directly by controller 72.

In a presently preferred form of the invention, a flow conduit 88 is arranged to spray water against the upper inner surface of side wall 12*a* for the purpose of lubricating such inner surface and thus facilitate relative uniform downward movement of the suspension within the standpipe with minimal bridging effects. It is also preferable to provide a further flow conduit 90, which is connected to a plurality of nozzles 92 arranged to inject water into standpipe 12 immediately above outlet opening 20 when necessary to lower the consistency of the suspension to be fluidized by operation of first rotor 34. Flow of water through conduits 88 and 90 may be controlled by controller 72, as indicated in FIG. 5.

Figure 6:
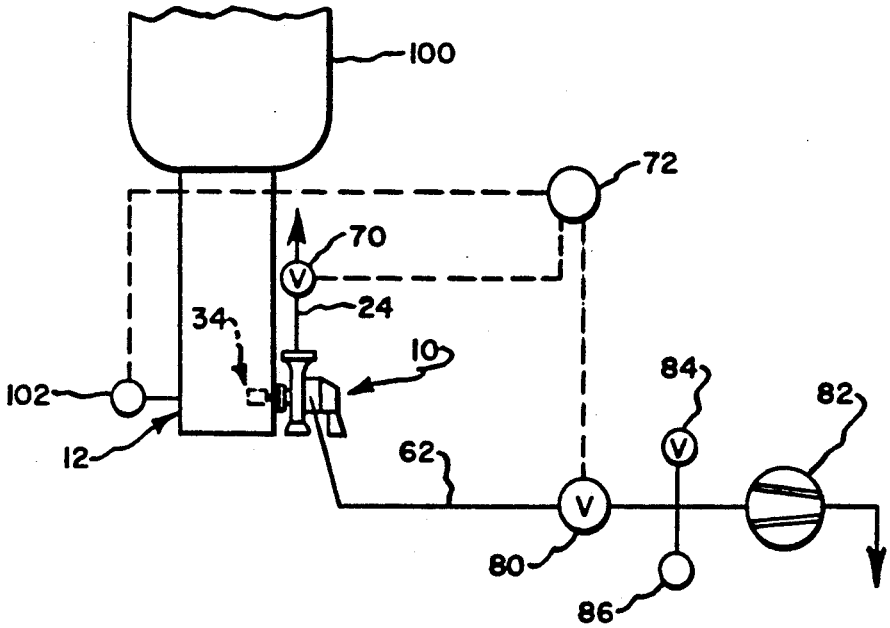
FIG. 6 is a diagrammatic view of an alternative control system.

It is also contemplated that the modified pump may be employed in extremely tall reservoirs, such as that designated as 100 in FIG. 6, wherein suspension levels typically exceed a range of between twenty-five and thirty-five feet at which the suction head is sufficient to reduce the amount of air separated from the suspension by the fluidizer to a point at which the air does not adversely effect operation of a centrifugal pump. When used in this type of installation, a conventional pressure transducer 102 may be used in place of height sensor 74 and controller 72 would serve to effect closure of gas control valve 80 when the height of the suspension would be sufficient to produce a pressure differential across the pump at which suspension would otherwise be lost through vent conduit 62, as well as to effect opening and closing of the gas control valve in accordance with the setting of liquid control valve 70. Thus, for this type of installation, the modified pump would only serve to effect removal of gas during start-up and shutdown of the system.

The term liquid, as used herein and in the appended claims, is meant to include liquids having entrained gas and liquid having both entrained gas and solids, such as fibers.

While the present invention has been described with reference to a centrifugal pump fitted with a specific form of semi-open impeller, it is to be understood that the invention possesses utility with fully closed impellers and modified semi-open impellers of the type described in our co-pending patent application Ser. No. 07/384,787 now U.S. Pat. No. 4,936,744 whose disclosure is specifically incorporated by reference herein.

What is claimed is:

1. A centrifugal pump installation for handling a fibrous suspension having a gas content to be pumped from a reservoir containing such suspension, said reservoir including a bottom wall, a side wall upstanding relative to said bottom wall and discharge means bounding a discharge opening extending through said side wall for discharging said suspension from within said reservoir, said pump installation comprising in combination:

a centrifugal pump housing defining a pumping chamber bounded in part by a rear wall, a suction inlet disposed in axial alignment with said discharge opening and cooperating therewith for placing said reservoir in flow communication with said pumping chamber and a discharge outlet disposed in radial flow communication with said pumping chamber and connected to a discharge conduit;

a drive shaft means passing through a drive shaft receiving opening in said rear wall, said pumping chamber, said suction inlet and said discharge means and projecting into said reservoir;

rotor means supported for rotation by said drive shaft means wholly within said reservoir and arranged for cooperation with said bottom wall for fluidizing said suspension within said reservoir adjacent said discharge opening, rotation of rotor means tending to centrifugally separate gas from said suspension for collection in a core area disposed concentrically of said drive shaft means;

an impeller supported for rotation within said pumping chamber by said drive shaft means, said impeller including a hub supported by said drive shaft means, an impeller shroud extending radially from said hub and having front and rear surfaces facing towards said suction inlet and rear wall, respectively, pumping vanes carried by said front surface for pumping said suspension between said suction inlet and said discharge outlet, pump-out vanes carried by said rear surface, a repeller shroud extending radially from said hub and disposed in a spaced facing relationship to said rear surface, said repeller shroud cooperating with said impeller shroud and said pump-out vanes for defining radially extending flow paths, and flow openings having front ends arranged for communication with said core area and rear ends disposed in flow communication with said flow paths; and gas removal means for withdrawing gas tending to collect within said pumping chamber outwardly of said drive shaft means between said rear wall and said repeller shroud, wherein said repeller shroud, said pump-out vanes, said flow openings, said impeller shroud and said pumping vanes having outer diameters of $D_R$, $D_{PO2}$, $D_{BH}$, $D_S$ and $D_2$, respectively, $D_R$ is equal to or greater than $D_{BH}$ and less than $D_{PO2}$, $D_S$ and $D_2$, and $D_{PO2}$ and $D_S$ are equal to or greater than $D_2$.

2. A pump installation according to claim 1, wherein said repeller shroud carries repeller vanes projecting rearwardly of said pump-out vanes, and an annular recess is formed in said rear wall concentrically outwardly of said pump shaft means and partially receives said repeller vanes.

3. A pump installation according to claim 2, wherein said pump-out vanes have free rear edges disposed adjacent said rear wall, and said repeller shroud is disposed forwardly of said rear edges and $D_R$ is essentially equal to the outer diameter of said annular recess.

4. A pump installation according to claim 1, wherein said front and rear ends of said flow openings pass through said front and rear surfaces of said shroud, and said repeller shroud has a rim disposed radially outwardly of said rear ends.

5. A pump installation according to claim 1, wherein an additional rotor means is carried by said drive shaft means wholly within said pump housing for imparting centrifugal force to said suspension passing from said discharge opening to said impeller.

6. A pump installation according to claim 5, wherein said rotor means is shaped to induce flow of said suspension axially thereof and outwardly of said reservoir through said discharge opening.

7. A pump installation according to claim 1, wherein said rotor means is shaped to induce flow of said suspension axially thereof and outwardly of said reservoir through said discharge opening.

8. A pump installation according to claim 1, wherein said gas removal means includes a vent conduit leading from said pumping chamber to a gas collection reservoir, a gas flow control valve arranged in said vent conduit, a suspension flow control valve disposed in said discharge conduit for adjustably controlling flow of said suspension therethrough, sensing means for sensing the height of said suspension within said reservoir and a controller, said controller adjustably controlling the setting of said suspension flow control valve in response to variations in said height of said suspension as sensed by said sensing means, and said gas control valve is controlled by one of said controller and said suspension flow control valve to assume a fully open condition when said suspension control valve is set in a preselected partially open condition and a fully closed condition when said suspension control valve is set in a condition less than said preselected partially open condition.

9. A pump installation according to claim 1, wherein said gas removal means includes a vent conduit leading from said pumping chamber to a gas collection reservoir, a gas flow control valve arranged in said vent conduit, a suspension flow control valve disposed in said discharge conduit for adjustably controlling flow of said suspension therethrough, sensing means for providing an indication of the height of said suspension within said reservoir and a controller, said controller adjustably controlling the setting of said suspension flow control valve to effect movement thereof between an essentially fully closed position and an essentially fully open position incident to an indication of increase in the height of said suspension above some predetermined value, and said gas flow control is controlled to assume a fully closed condition whe said suspension flow control valve assumes a position between said fully closed position and a predetermined partially open position thereof and when the height of said suspension essentially corresponds to or exceeds a value at which centrifugal action imposed on said suspension by operation of said pump is insufficient to separate gas from said suspension in quantities sufficient to adversely affect operation of said pump, to assume a fully open condition when said suspension control valve assumes a position between said predetermined partially open position and said fully open position, and to remain in said fully open condition while said suspension control valve is in said fully open position until said height of said suspension essentially corresponds to said value.

10. The combination of a reservoir for containing a fibrous suspension having entrained gas and a centrifugal pump for pumping said suspension from said reservoir;

said reservoir including a bottom wall, a side wall upstanding relative to said bottom wall and discharge means bounding a discharge opening extending through said side wall for discharging said suspension from within said reservoir; and said pump comprising a centrifugal pump housing defining a pumping chamber bounded in part by a rear wall, a suction inlet disposed in axial alignment with said discharge opening and cooperating therewith for placing said reservoir in flow communication with said pumping chamber, a discharge outlet disposed in flow communication with said pumping chamber, an opening extending through said rear wall in alignment with said suction inlet and gas vent means opening through said rear wall adjacent said opening therein; shaft means passing through said opening in said rear wall, said pumping chamber, said suction inlet and said discharge means and projecting into said reservoir; rotor means supported for rotation by said drive shaft means wholly within said reservoir and arranged for cooperation with said bottom wall for fluidizing said suspension within said reservoir adjacent said discharge opening, rotation of rotor means tending to centrifugally separate gas from s id suspension for collection in a core area disposed concentrically of said drive shaft means; an impeller supported for rotation within said pumping chamber by said drive shaft means, said impeller including a hub supported by said drive shaft means, an impeller shroud extending radially from said hub and having front and rear surfaces facing towards said suction inlet and rear wall, respectively, pumping vanes carried by said front surface for pumping said suspension between said suction inlet and said discharge outlet, pump-out vanes carried by said rear surface, a repeller shroud extending radially from said hub and disposed in a spaced facing relationship to said rear surface, said repeller shroud cooperating with said impeller shroud and said pump-out vanes for defining radially extending flow paths and being spaced from said rear surface to permit passage of said gas therebetween from said flow paths to said gas vent means, and flow openings having front ends arranged for flow communication with said core area and rear ends disposed in flow communication with said flow paths, said repeller shroud extends radially coextensive with or outwardly of said rear ends of said flow openings and said vent means and has a radial extent less than said impeller shroud and said pump-out vanes, and said pump-out vanes and said impeller shroud have outer diameters equal to or greater than the diameter of said pumping vanes.

11. The combination according to claim 10, wherein said repeller shroud carries repeller vanes projecting rearwardly of said pump-out vanes, said vent means includes an annular recess formed in said rear wall concentrically outwardly of said opening therein, and said repeller vanes project into said annular recess.

12. The combination according to claim 11, wherein said pump-out vanes have free rear edges disposed adjacent said rear wall, and said repeller shroud is disposed forwardly of said rear edges and has a diameter essentially equal to an outer diameter of said annular recess.

13. The combination according to claim 10, wherein an additional rotor means is carried by said drive shaft means axially intermediate said rotor means and said impeller for imparting centrifugal force to said suspension passing from said reservoir to said impeller.

14. A pump installation according to claim 10, wherein said rotor means is shaped to induce flow of said suspension axially thereof and outwardly of said reservoir through said discharge opening.

15. The combination according to claim 10, wherein said gas vent means is connected to a vent conduit leading to a gas collection reservoir, a gas flow control valve is arranged in said vent conduit, a suspension flow control valve is disposed in a discharge conduit connected to said discharge outlet for adjustably controlling flow of said suspension therethrough, sensing means is provided for sensing the height of said suspension within said reservoir and a controller is provided for adjustably controlling the setting of said suspension flow control valve in response to variations in said height of said suspension as sensed by said sensing means, and said gas control valve is controlled by one of said controller and said suspension flow control valve to assume a fully open condition when said suspension control valve is set in a preselected partially open condition and a fully closed condition when said suspension control valve is set in a condition less than said preselected partially open condition.

16. The combination according to claim 15, wherein a first conduit is provided for applying water to an inner surface of said side wall of said reservoir adjacent an upper end thereof, and a second conduit is provided for injecting water into suspension adjacent a lower end of said reservoir above said discharge opening for reducing the consistency of said suspension to be fluidized by cooperation of said rotor means and said bottom wall.

* * * * *

UNITED STATES PATENT AND TRADEMARK OFFICE

CERTIFICATE OF CORRECTION

PATENT NO. : 5,087,171

DATED : February 11, 1992

INVENTOR(S) : Joseph B. Dosch et al

It is certified that error appears in the above-indentified patent and that said Letters Patent is hereby corrected as shown below:

Col. 1, line 47 - "ga" should be --gas--.

Col. 5, line 20 - "o" should be --of--.

Col. 8, line 51 - "ga" should be --gas--.

Col. 9, line 33 - "as" should be --gas--.

Col. 12, line 19 - "whe" should be --when--.

Col. 12, line 53 - before "shaft" insert --a drive--.

Col. 12, line 62 - "sid" should be --said--.

Signed and Sealed this

Twentieth Day of July, 1993

*Attest:*

Michael K. Kirk

MICHAEL K. KIRK

*Attesting Officer*

*Acting Commissioner of Patents and Trademarks*